US006334624B1

(12) United States Patent
Giglio

(10) Patent No.: US 6,334,624 B1
(45) Date of Patent: Jan. 1, 2002

(54) WHEELCHAIR USERS EXERCISE DEVICE

(76) Inventor: Joseph Giglio, 26 Victor Ave., West Long Branch, NJ (US) 07764

( * ) Notice: Subject to any disclaimer, the term of this patent is extended or adjusted under 35 U.S.C. 154(b) by 0 days.

(21) Appl. No.: 08/587,228

(22) Filed: Jan. 16, 1996

(51) Int. Cl.[7] ..... A63B 21/008

(52) U.S. Cl. ..... 280/304.1; 482/112; 482/128; 482/904

(58) Field of Search ..... 280/304.1; 482/904, 482/121, 128, 129, 112

(56) References Cited

U.S. PATENT DOCUMENTS 3,295,847 A * 1/1967 Matt, Sr. ..... 482/128 X
4,563,001 A * 1/1986 Terauds ..... 482/112 X
4,786,051 A * 11/1988 Mullican ..... 482/112 X
4,946,162 A * 8/1990 Lubie ..... 482/904 X
5,242,179 A * 9/1993 Beddome et al. .... 280/304.1 X
5,273,304 A * 12/1993 Berkheimer ..... 280/304.1
5,280,937 A * 1/1994 Needham ..... 280/304.1 X

* cited by examiner

*Primary Examiner*—Kevin Hurley

(57) ABSTRACT

A leg exerciser for the wheelchair bound includes a frame which is placed on the floor. The portions of the frame which touch the floor may be covered with protective material. The frame has a vertical bracket at one end thereof formed as a rectangle about an open interior. This bracket is mounted between the small front wheels and the larger main wheels of a wheelchair. A portion of each of the front wheels is securely retained in the bracket's open interior. This arrangement thus serves to fix the position of the wheelchair relative to the exerciser and to prevent relative movement between the wheelchair and the exerciser. The forces exerted on the exerciser are directed so that the front wheels of the chair are caused to engage the bracket which prevents the rearward movement of the chair and any forward movement of the exerciser. Two shock absorbers provide resistance against radius arms to which foot pedals are attached. Return force is provided to cause the foot pedals and the radius arms to return to an initial resting position.

9 Claims, 5 Drawing Sheets

WHEELCHAIR USERS EXERCISE DEVICE

BACKGROUND OF THE INVENTION

1. Field of the Invention

The present invention relates to a wheelchair users leg exercise device which is designed for use at the home and while the user remains in the wheelchair. The invention includes a frame having a portion which fits behind the front wheels of the wheelchair and return spring loaded shock absorber type resistance members. Pedals are provided and the user can operate the each pedal in any sequence or may operate both pedals simultaneously.

2. Description of the Prior Art

The prior art recognizes the value of exercise for all persons including the wheelchair bound. Some of the relevant prior art teachings are described in the following U.S. patent documents.

Walker, U.S. Pat. No. 3,754,547, covers an exercise device for the disabled. FIG. 3 shows a connection of the device to a wheelchair, while the detail of how the chair is connected to the device is discussed at column 5. The proposed structure for the connection is much more complex than that employed in the present invention.

Dixon, U.S. Pat. No. 4,550,908, provides and exercise apparatus for stroke victims. This is a powered device designed for use at a rehabilitation center, rather than in the home.

Lambert, U.S. Pat. No. 4,869,494 connects a powered exercise to the chair via a shaft 19 so that the chair is caused to move by the motor 18.

Salkind U.S. Pat. No. 4,883,268 is a rowing machine for wheelchair exercisers. The device relies on rubber friction gripping members to inhibit shifting along the floor and employs a shock absorber type device 52 for the arm rower.

Kynast, U.S. Pat. No. 4,911,425 supports the entire chair in parallel ramps which serve to lock the chair in a position, then the ramps can be adjusted from full tilt, to level.

Miller, U.S. Pat. No. 4,936,573 discloses a foot exerciser which does not connect to the seat of the user.

Lubie, U.S. Pat. No. 4,946,162 uses inter-connected hydraulic cylinders so that when one leg is fully extended, the other leg is contracted in a step-by-step fashion.

Hix, U.S. Pat. No. 4,949,954 interconnects movement of the arms and lefts of the user.

Hess, U.S. Pat. No. 5,279,530 uses a plurality of elastic cords to provide the resistance in a leg exerciser. Straps 70 connect the exerciser to a pad on which the person lies.

Miller, U.S. Pat. No. 5,308,302 is similar to Miller, U.S. Pat. No. 4,936,573 and adds a channel on the exerciser for supporting the chair of the user.

SUMMARY OF THE INVENTION

The present invention is leg exerciser for the wheelchair bound. The exerciser includes a frame which is placed on the floor. The portions of the frame which touch the floor may be covered with rubber non-skid protective material. The frame has a vertical bracket at one end thereof formed as a rectangle about an open interior. This bracket is mounted between the small front wheels and the larger main wheels of a wheelchair. A portion of each of the front wheels is securely retained in the bracket's open interior. This arrangement serves to fix the position of the wheelchair relative to the exerciser and to prevent relative movement between the wheelchair and the exerciser. The forces exerted on the exerciser are directed so that the front wheels of the chair are caused to engage the bracket which prevents the rearward movement of the chair and any forward movement of the exerciser.

The frame has two shock absorbers attached between the frame and radius arms. The ends of each radius arm have pedals attached for driving each radius arm against the resistance of the shock absorbers. Return springs are also attached between the radius arms and the frame. The springs provide the return force exerted by the device on a user's leg by controlling the return movement of the pedals.

A principal object of the present invention is the provision of a leg exerciser for the wheelchair bound. Another object and advantage of the present invention is the provision of a leg exerciser which easily attaches to a wheelchair for use. A still further object and advantage of the invention is the provision of wheelchair exerciser which may be set up by the user, if able, without the aid of another person. Another object and advantage of this invention is the provision of a connection between a wheelchair and a leg exerciser which employs the front wheels of a wheelchair by securely retaining them in a bracket portion of the leg exerciser.

Another object and advantage of the invention is the provision of a leg exerciser for the wheelchair bound which controls the amount of force applied to the legs of the user by dampers. A still further object and advantage of my invention is the provision of a leg exerciser for the wheelchair bound which can be operated by either leg sequentially and/or both legs simultaneously. An important object and advantage of my invention is the provision of a leg exerciser which provides foot pedals attached to a pivoting radius arm. Another object and advantage of my invention is the provision of a leg exerciser where the foot pedals exert force against the resistance of a shock-absorber type element. A still further object and advantage of my invention is the provision of an exerciser which may also be used with a four legged chair;

BRIEF DESCRIPTION OF THE DRAWINGS

These as well as further objects and advantages of the invention will become apparent to those skilled in the art from a review of the following detailed description of our invention, reference being made to the accompanying drawings in which.

DESCRIPTION OF THE PREFERRED EMBODIMENTS

Figure 1:
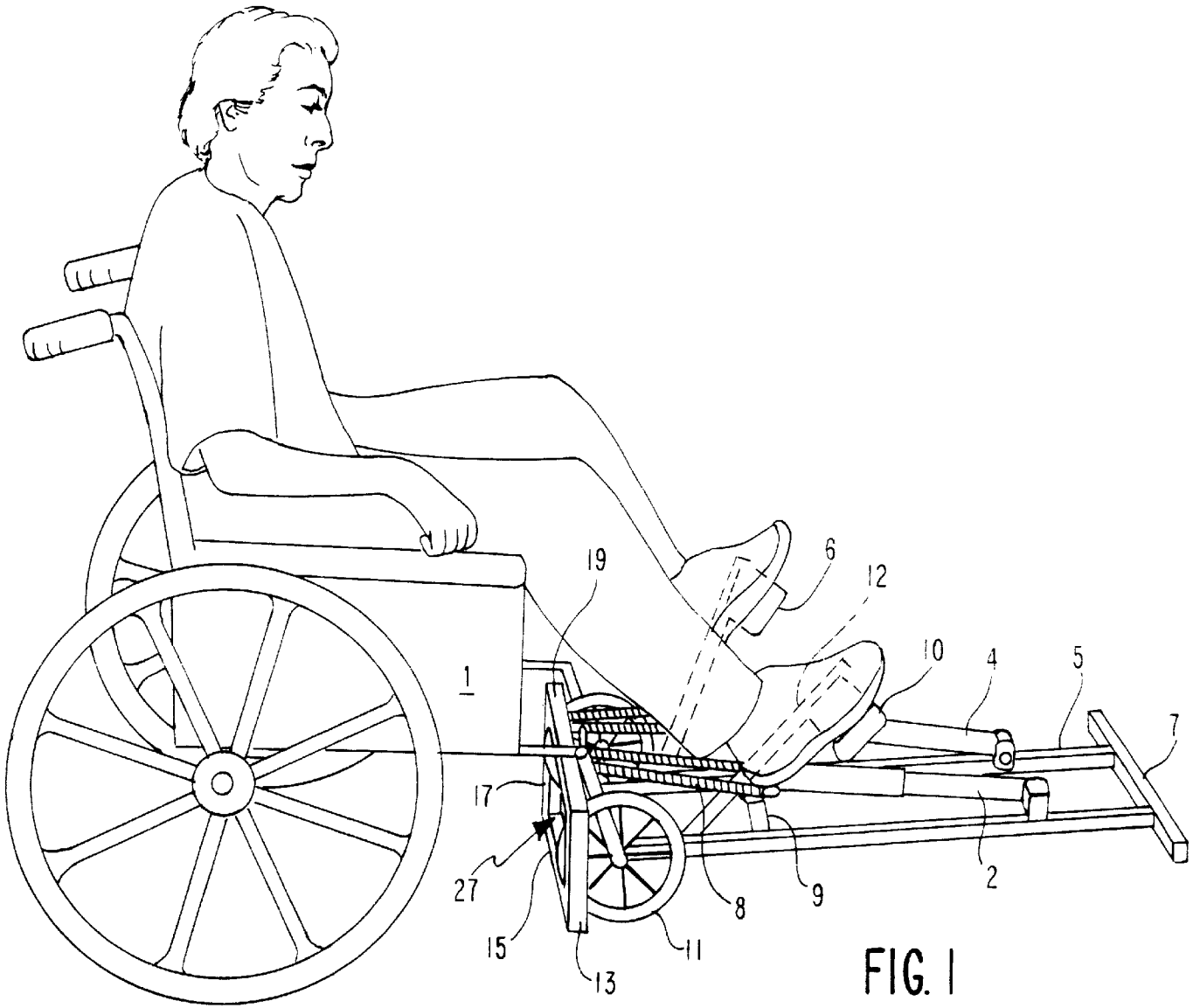
FIG. 1 is a perspective view of my invention.

As shown in FIG. 1, the wheelchair user sits in the wheelchair in the normal manner. The front wheels 11 of the wheelchair 1 are positioned in front of a rectangular bracket mounted vertically with respect to the floor. The bracket end member is formed by two horizontal portions, 15 and 19 and two vertical portions, 13 and 17. The vertical portions 13 and 17 are shorter in length than the horizontal portions 15 and 19. The rectangular space between the vertical and horizontal elements of the bracket end member must be large enough to support a portion therein of the outer diameter of the front wheel 11 of the wheelchair 1. This is shown in detail in FIG. 2 where the front wheel 11 is securely supported in the bracket formed by horizontal portion 19 and vertical portion 13 in FIG. 2.

The invention includes a supporting frame consisting of an end bar 7 and two lateral bars 3 and 5. The bracket end member discussed above is supported by lateral support 9 connected between the lateral bars 3 and 5. The lateral support 9 has a cross-brace 20 attached thereto and to the top 19 of the bracket end member. As will now be seen, the bracket is attached to the lateral bars 3 and 5 and connected by a cross-brace 20 attached to the bars 3 and 5 via lateral support 9.

Figure 2:
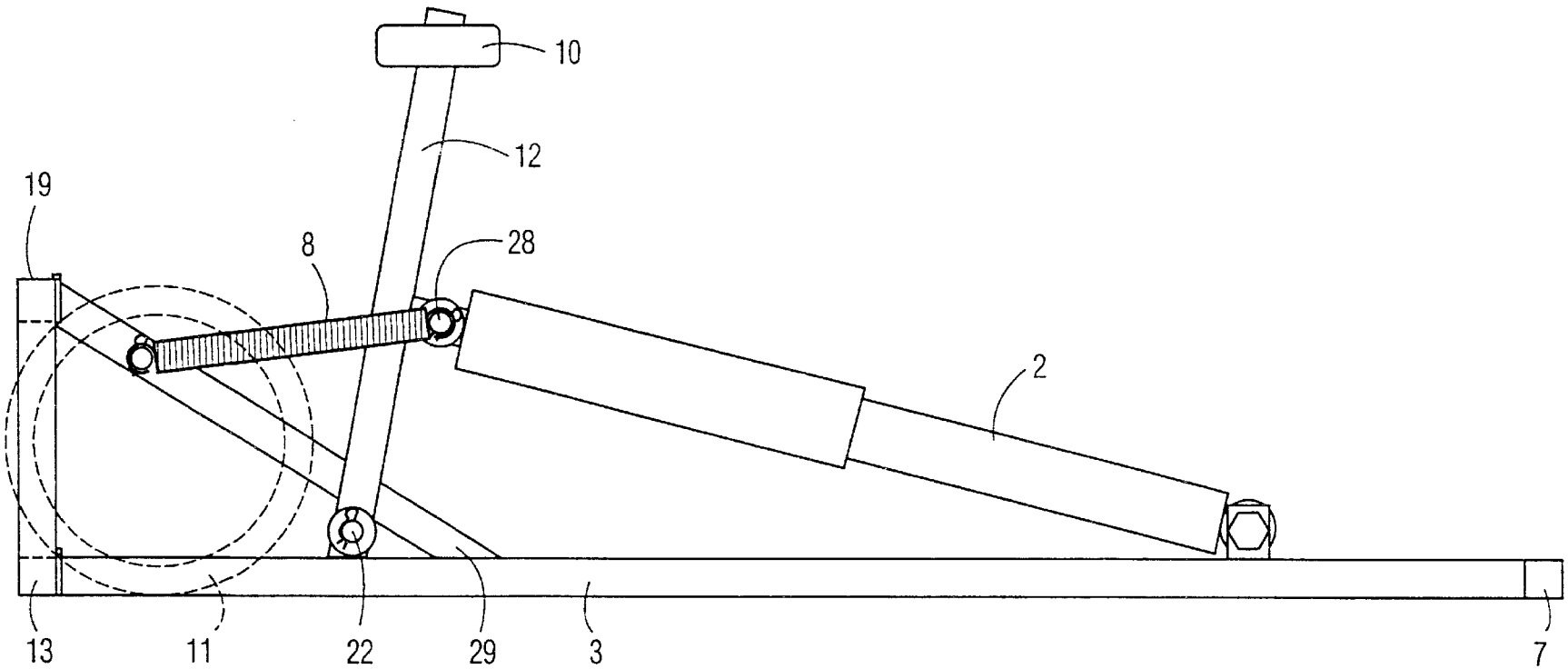
FIG. 2 is a side view of the apparatus in FIG. 1.

With reference to FIG. 2, a side view of the apparatus of FIG. 1, one of the two pivoting radius arms 12 is shown having a foot pedal 10 attached thereto in the standard manner. The radius arm 12 is pivotally attached to the lateral bar 3 at 22. The radius arm 12 is also connected to shock absorber 2. In a similar manner, another pivoting radius arm (shown in FIG. 1 being used by the left foot) has foot pedal 6 attached thereto. This radius arm is pivotally mounted to lateral bar 5 and is connected to shock absorber 4. A set of return springs shown as 8, 21, 23 and 25 in FIG. 3 are connected to posts 24 and 26 attached laterally across the brace support 20, and to the point of connection 28 of the shock absorber 2 with the pivoting radius arm 12.

Figure 3:
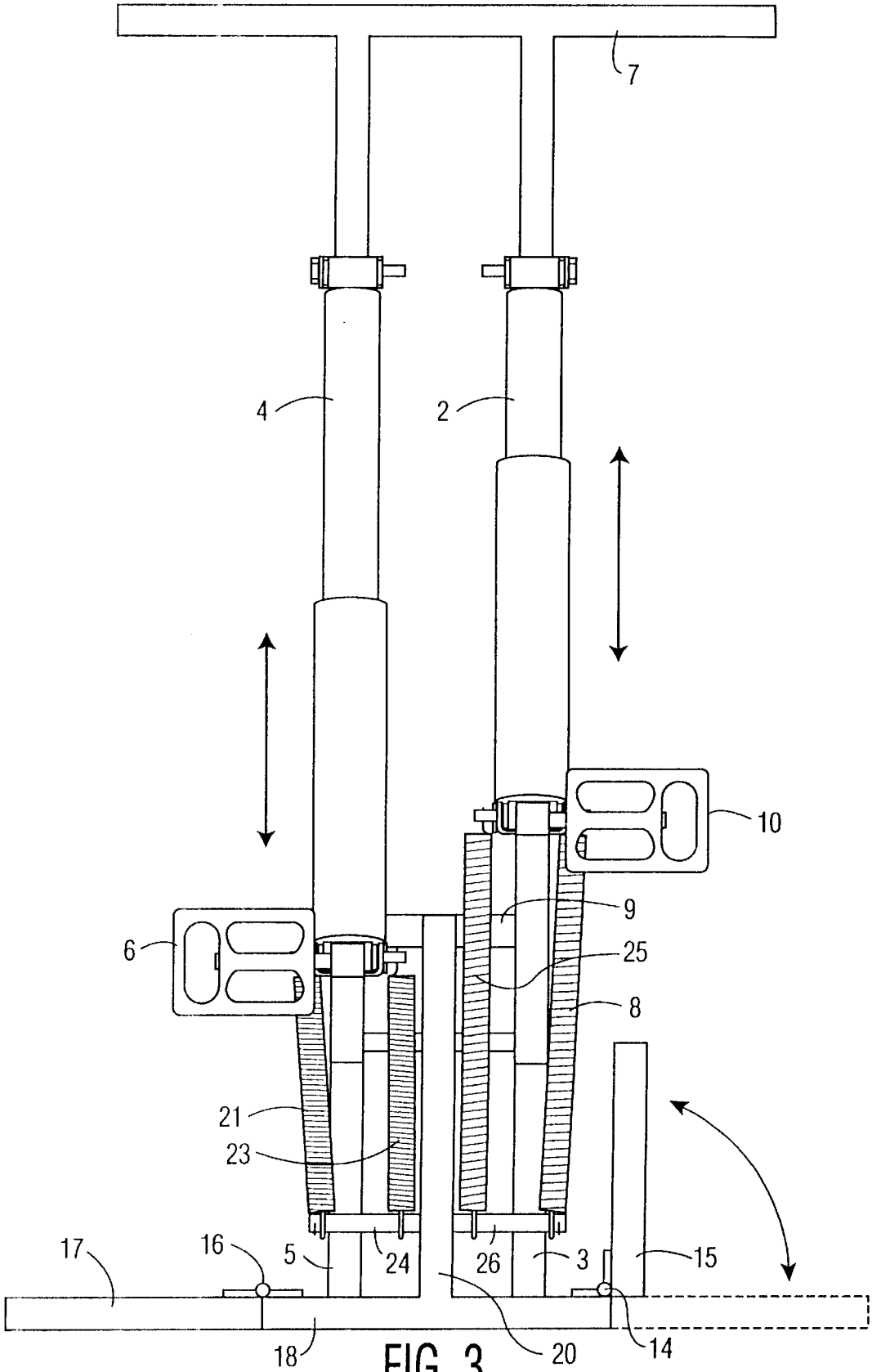
FIG. 3 is a top view of a modified apparatus shown in FIG. 2.

As is further shown in FIG. 3, portions of the bracket to which the front wheels of the chair are engaged may be hinged with hinges 14 and 16. These hinges enable the wheelchair user to position the front wheels of the chair in the proper location (if the user has that capability), or, the hinged sections may aid an assistant or a therapist in positioning the chair relative to the support bracket. The hinges 14 and 16 connect sections 15 and 17 of the top bracket member to a central fixed bracket section 18.

In operation, the wheelchair is first positioned with its front wheels between the bracket and the pedals. The hinged sections of the bracket may be operated to aid in the location of the front wheels of the chair relative to the bracket. The user then places the feet on the pedals 6 and 10. The user may then push against the resistance provided by the shock absorbers 2 and 4. The amount of return force applied to the user's feet and leg is controlled by the return springs 8, 21, 23 and 25. The user can exercise the right or the left leg independently of each other as the two pedals 6 and 10 operate independently of one another.

Figure 4:
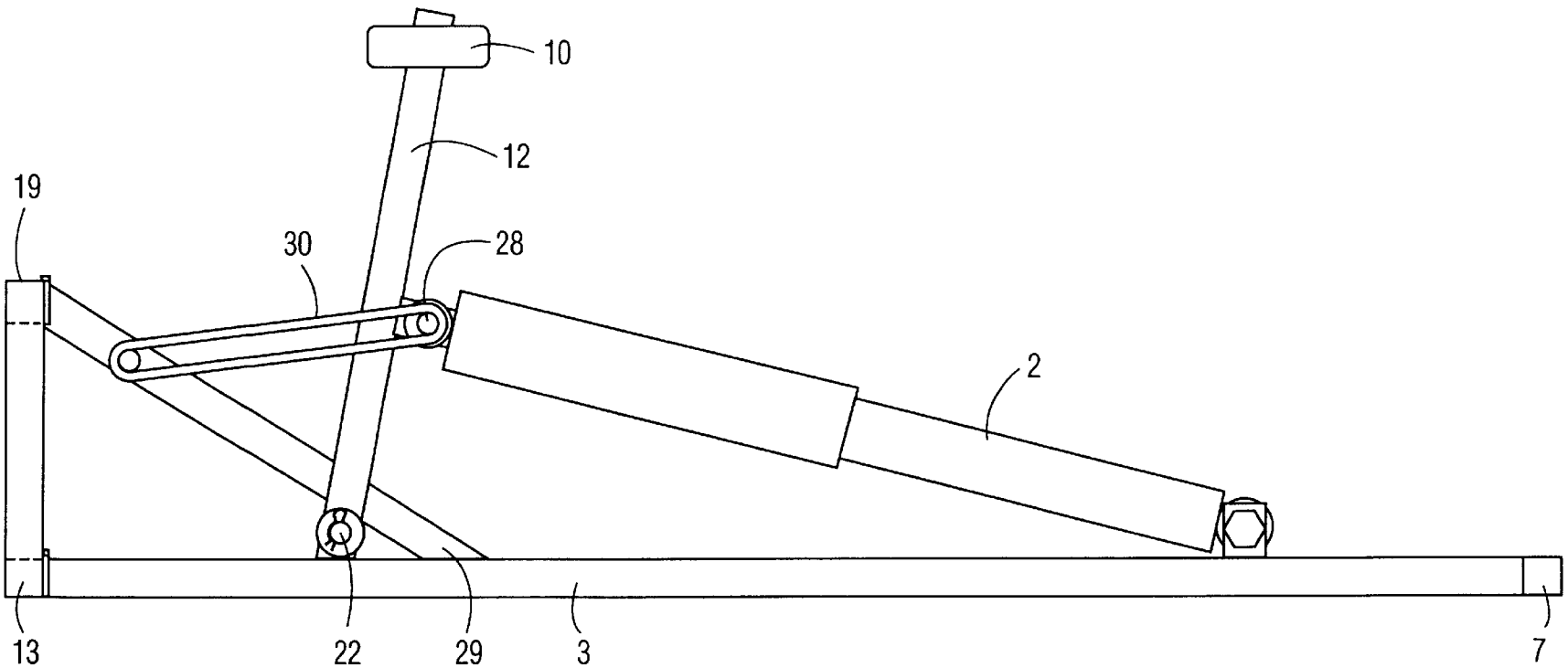
FIG. 4 is a side view of a further modification of the apparatus of FIG. 2.
Figure 5:
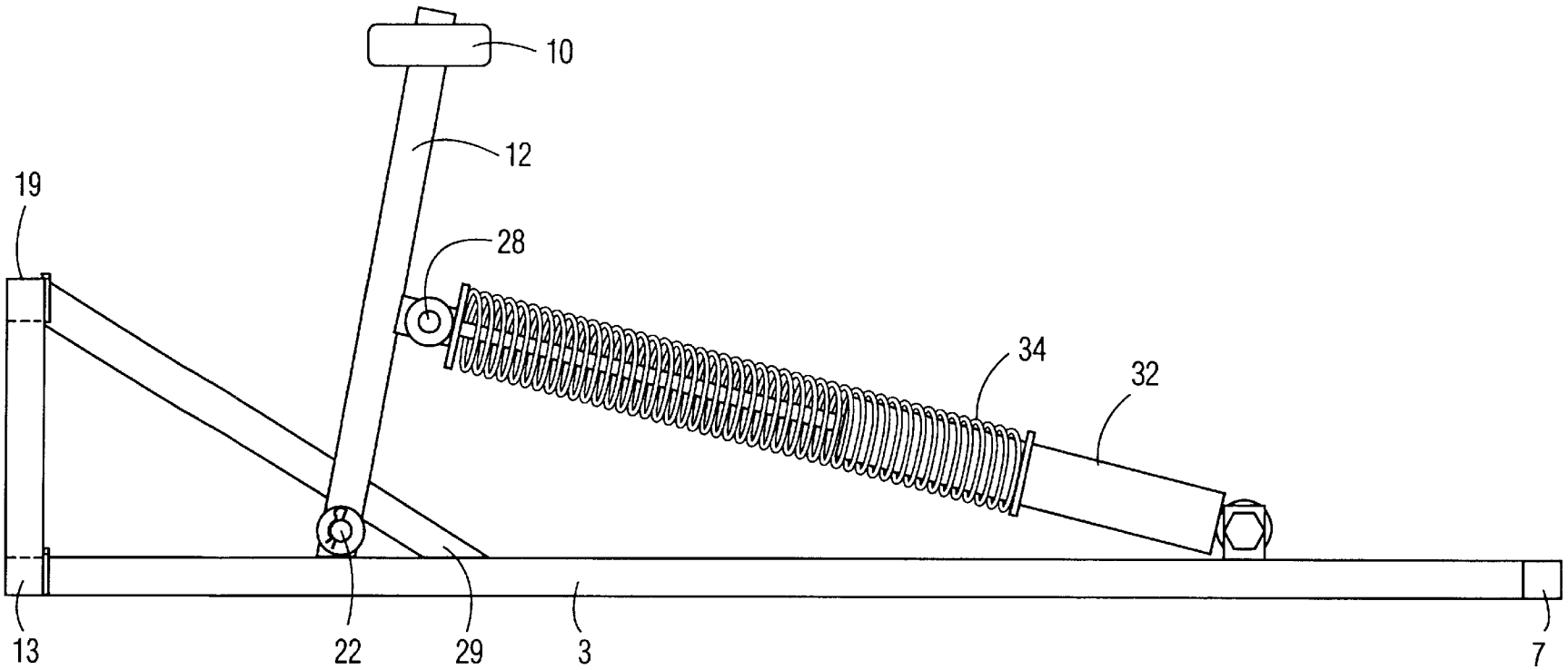
FIG. 5 is a side view of another modification to the apparatus of FIG. 2.

While the preferred embodiment has been described as using springs such as 8, 21, 23 and 25, large elastic bands 30 shown in FIG. 4 may be used in lieu of the springs. Further, the shock absorbers 2 and 4 may be a hydraulic type shown in FIGS. 1–4 or a multi position resistance gas shock absorber having variable degrees of resistance to suit the user shown at 32 in FIG. 5. If a shock absorber of the type shown in FIG. 5 is employed, then the return springs 8, 21, 23 and 25 and related spring supports are unnecessary. The return forces are provided by the spring 34 surrounding the shock absorber 32.

Further modifications to the method and apparatus of the invention may be made without departing from the spirit and scope of the invention; accordingly, what is sought to be protected is set forth in the appended claims.

I claim:

1. A leg exerciser for the wheelchair bound comprising a frame including two lateral bars and one end member and one end bar connected across said lateral bars; one of said end members comprising of a vertical rectangular bracket mounted on one end of said lateral bars for receiving and retaining the front wheels of a wheelchair; first and second radius arms mounted on respective one of said parallel members; foot pedal means for excerising the legs of a wheelchair user attached to each of said radius arms; a shock absorbing damper attached between each of said radius arms and said parallel members for causing resistance against the compression caused by pressure on said foot pedal; and return force means connected between said frame and each of said radius arms for generating a return force against said foot pedal means.

2. The exerciser of claim 1 wherein said return force means including a spring.

3. The exerciser of claim 1 wherein said return force means including an elastic band.

4. The exerciser of claim 1 wherein said bracket includes a moveable section to assist in positioning said wheelchair.

5. The exerciser of claim 1 wherein the vertical rectangular bracket may be positioned behind the front wheels of a wheelchair so that the force exerted on said foot pedals by a wheelchair user will cause a portion of the front wheels of a wheelchair to securely engage said vertical rectangular bracket.

6. A leg exerciser for the wheelchair bound comprising: frame means for supporting a leg exerciser: said frame frame means including an appertured means of attachment integrated into said frame means for retaining the front wheels of a wheelchair therein, thereby forming a wheelchair/exerciser combined unit, resistance means to exercise the legs attached to said frame for providing exercise resistance to the legs of a person; a return force means attached to said resistance means and to said frame of said exercise device for generating a return force to return said resistance means to an initial position and foot pedal means for supporting a user's foot attached to said frame.

7. A leg exerciser for the wheelchair bound comprising: a frame having two parallel support members and two end members connected across the ends of said parallel members; a vertical bracket mounted on one of said end members, said vertical bracket including first and second end sections mounted on one of said end members and a lateral cross section mounted on said end sections parallel to and a distance above said end member forming a space for retaining a portion of the front wheels of a wheelchair therein, first and second radius arms connected to said frame, each of said radius arms having a foot pedal means attached thereto for supporting the user's feet; first and second shock absorber means connected between said frame and said radius arms for providing resistance to said foot pedal means; return force generating means attached to said frame and each of said radius arms for exerting a force to return the user's foot to a rest position.

8. The exerciser of claim 7 wherein said frame is mounted on a floor and includes protective means to prevent said frame from sliding on a floor and to protect said floor.

9. The exerciser of claim 7 wherein said vertical bracket includes at least one hinged section means therein for moving a portion of said vertical bracket to assist in positioning the front wheels of a wheelchair for proper engagement with said vertical bracket.

* * * * *